US008740582B2

(12) United States Patent
Rabe

(10) Patent No.: US 8,740,582 B2
(45) Date of Patent: Jun. 3, 2014

(54) MAINTENANCE MACHINE FOR REFRIGERATION UNITS WITH REVERSIBLE MOTOR

(75) Inventor: Gerd H. Rabe, Meinerzhagen (DE)

(73) Assignee: Inficon GmbH (DE)

( * ) Notice: Subject to any disclaimer, the term of this patent is extended or adjusted under 35 U.S.C. 154(b) by 124 days.

(21) Appl. No.: 13/379,315

(22) PCT Filed: May 27, 2010

(86) PCT No.: PCT/EP2010/057349

§ 371 (c)(1),
(2), (4) Date: Dec. 19, 2011

(87) PCT Pub. No.: WO2010/149461

PCT Pub. Date: Dec. 29, 2010

(65) Prior Publication Data

US 2012/0100018 A1 Apr. 26, 2012

(30) Foreign Application Priority Data

Jun. 23, 2009 (DE) ..... 10 2009 029 923

(51) Int. Cl.

| | |
|---|---|
| ***F04D 13/12*** | (2006.01) |
| ***F04B 23/04*** | (2006.01) |
| ***F25B 45/00*** | (2006.01) |

(52) U.S. Cl.

USPC ..... 417/350; 417/326; 417/316; 417/426; 62/77; 62/292; 62/149

(58) Field of Classification Search

USPC ..... 417/410.1, 326, 350, 316, 426; 62/77, 62/149, 292, 298, 174, 475

See application file for complete search history.

(56) References Cited

U.S. PATENT DOCUMENTS

| | | | | |
|---|---|---|---|---|
| 3,118,463 | A * | 1/1964 | Lacart | 137/343 |
| 4,283,167 | A * | 8/1981 | Bassan et al. | 418/13 |
| 5,540,254 | A * | 7/1996 | McGowan et al. | 137/315.01 |
| 5,606,862 | A | 3/1997 | Peckjian et al. | |
| 5,678,415 | A | 10/1997 | Peckjian et al. | |
| 8,225,618 | B2 * | 7/2012 | Boyd et al. | 62/77 |

FOREIGN PATENT DOCUMENTS

| | | | |
|---|---|---|---|
| EP | 1 332 964 | A1 | 8/2003 |
| GB | 2 083 865 | A | 3/1985 |
| WO | WO 2007/128127 | A1 | 11/2007 |

OTHER PUBLICATIONS

VIOT HVAC Gauge Manifolds, www.viot.us/showFAQ.php?model=GM410&sw=0, Copyright 2007.*

HVAC 101 evacuating AC unit and adding refrigerant, http://www.youtube.com/watch?v=W6mzdUfdSNM, uploaded Nov. 24, 2009.*

International Search Report/Written Opinion for PCT Application No. PCT/EP2010/057349; mailed Apr. 1, 2011; 9 pages.

* cited by examiner

*Primary Examiner* — Devon Kramer
*Assistant Examiner* — Nathan Zollinger
(74) *Attorney, Agent, or Firm* — Hiscock & Barclay, LLP

(57) ABSTRACT

For refrigeration units, maintenance machines are required that can receive and compress the refrigerant from the refrigeration unit. Furthermore, a vacuum pump is required, which is connected to the emptied lines and pumps out humidity and air. The maintenance machine according to the invention includes a motor that drives a compressor via a freewheel in one rotational direction. The same motor drives a vacuum pump via a second freewheel in the other rotational direction. The maintenance machine, which can perform two different functions, includes only one single motor. The machine is lightweight, so that it can be carried by the maintenance personnel. Furthermore, it is small and can be produced in a cost-effective manner.

3 Claims, 2 Drawing Sheets

MAINTENANCE MACHINE FOR REFRIGERATION UNITS WITH REVERSIBLE MOTOR

CROSS REFERENCE TO RELATED APPLICATIONS

Pursuant to 35 USC §371, this application is a National Stage of International Application No. PCT/EP2010/057349, filed May 27, 2010, which claims priority to German Patent Application No. 1020090299218, filed Jun. 23, 2009 under applicable paragraphs of 35 USC §119, wherein the entire contents of each above-noted document is herein incorporated by reference.

TECHNICAL FIELD

The invention refers to a maintenance machine for refrigeration units, comprising a compressor driven by a motor.

BACKGROUND

For the maintenance of refrigeration units, such as air condition systems or freezing systems, a maintenance technician uses various maintenance machines, each of which he has to transport to the respective site of use. Generally, the maintenance machines are transported along in a vehicle and have to be unloaded at the site of use and may have to be carried to the site of use over stairs and for longer distances. The maintenance machines include a refrigerant recovery machine (RRM) and a vacuum pump (VP). These maintenance machines are used independently and at different times. Each maintenance machine is rather heavy (12-14 kg) and has the size of a small suitcase. The refrigerant recovery machine further comprises a storage tank and scales. If a maintenance technician wants to seal a leak in a refrigerant circuit, the circuit has to be emptied first. In this context, environment protection regulations require that the refrigerant removed from the system is collected and that any refrigerant vapor is led into a refrigerant recovery tank together with the refrigerant. For this purpose, the maintenance machine is provided with a compressor that compresses the discharged refrigerant and pumps it into a storage tank.

Another type of maintenance machine comprises a vacuum pump driven by a motor of its own. The vacuum pump is used to draw air and water vapor from the pipe system of the refrigeration unit after the refrigerant has been drained before. Humidity and refrigerant do not go along with each other. The vacuum pump serves to dry the pipe system. For this purpose, a specific vacuum must be maintained for a certain time.

U.S. Pat. No. 5,606,862 and U.S. Pat. No. 5,678,415 each describe a maintenance machine. The maintenance machine has a motor with two shafts, one of which is adapted to drive a compressor via a first clutch and the second shaft is adapted to drive a vacuum pump via a second clutch. Shifting the clutches requires control operations.

SUMMARY

It is an object of the invention to provide a maintenance machine for refrigeration units in which the drive of the compressor and of the vacuum pump is simplified and requires no shilling operation to actuate a clutch.

It is another object of the present invention to provide a maintenance machine for refrigeration units that combines different functions, is lightweight and substantially reduces the investment costs for service companies.

It is characterized in that the same motor may selectively be connected to the compressor or to a vacuum pump in order to drive either one.

According to the invention a first freewheel is provided between the motor and the compressor and a second freewheel is provided between the motor and the vacuum pump. The direction of rotation of the motor can be inversed and the first and second freewheels have opposite rotational directions of entrainment, so that the motor drives the compressor in the one direction of rotation, while it drives the vacuum pump in the other direction of rotation. Thus, no clutches are required to couple the respective machine to the motor. The machine to be operated, i.e. compressor or vacuum pump, is selected by actuating the rotational direction switch of the motor. The motor is a reversible electric motor.

According to a preferred embodiment of the invention it is provided that the motor drives a blower that ventilates a cooler connected to the compressor when the compressor is driven. The blower may also be connected to the motor such that it is operative in any rotational direction of the motor.

The vacuum pump used is generally a pump that is of a simple structure and is economic to manufacture, in particular a rotary vane pump. The compressor may be a piston compressor with a linearly displaced piston.

According to a preferred embodiment of the invention a valve device is provided that comprises a first connector connected to the inlets of the compressor and of the vacuum pump, and two further connectors adapted to be connected to refrigerant lines of the refrigeration unit, the valve device, in a first state, connecting the first connector to one of the further connectors and, in the second state, connecting the first connector to the other of the further connectors. The maintenance technician thus has to connect the refrigeration unit to the maintenance machine through only two hoses in order to drain the refrigerant and dehumidify the circuit using one and the same machine.

BRIEF DESCRIPTION OF THE DRAWINGS

The following is a detailed description of an embodiment of the invention with reference to the drawings.

DETAILED DESCRIPTION

Figure 1:
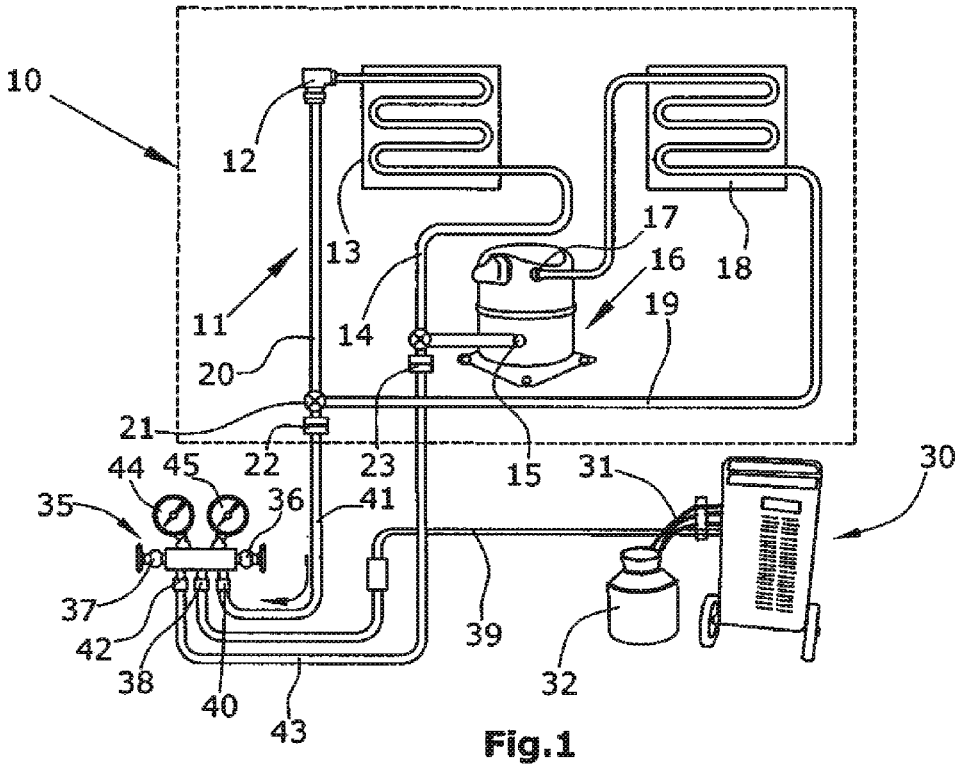
FIG. 1 illustrates the connection of a maintenance machine to a refrigeration unit.

FIG. 1 illustrates a refrigeration unit, e.g. an air condition system in a building. The refrigeration unit 10 comprises a refrigerant circuit 11 in which a refrigerant such as Frigen circulates. The refrigerant circuit comprises an expansion nozzle 12 and an evaporator 13. The evaporator is a heat exchanger that emits the cold produced by the expansion process to the environment to be cooled. A line 14 leads from the outlet of the evaporator 13 to the inlet 15 of a compressor 16. The compressor 16 has an outlet 17 connected to a condenser 18. The condenser 18 is a heat exchanger that emits the heat produced during the compression of the initially gaseous refrigerant. The outlet of the condenser 18 is connected through a line 19 to the line 20 leading to the inlet of the evaporator 13. At the connection point 21 of the lines 19 and 20, an access port 22 is provided for the connection of a maintenance machine. A further access port 23 is provided at the inlet 15 of the compressor 16.

For the maintenance of the refrigerating unit 10, a maintenance machine 30 is provided that is carried along by the maintenance technician. The inner structure of the maintenance machine 30 will be explained later. A tank 32 is connected to the maintenance device via hoses 31, the tank receiving the refrigerant. The tank 32 is a closed pressure tank.

The maintenance machine 30 further comprises a valve means 35 illustrated separately in FIG. 1. The valve device is physically integrated in the maintenance machine. The valve device 35 includes two valves 36 and 37 to be operated manually. A first connector 38 of the valve device is connected to the compressor and the vacuum pump of the maintenance machine 30 through a line 39. A further connector 40 may be connected to the access port 22 via a hose 41. Another connector 42 may be connected to the access port 23 through a hose 43. The valve 36 controls the connection between the connectors 38 and 40. The valve 37 controls the connection between the connectors 38 and 42. Further the valve device is provided with manometers 44 and 45.

Figure 2:
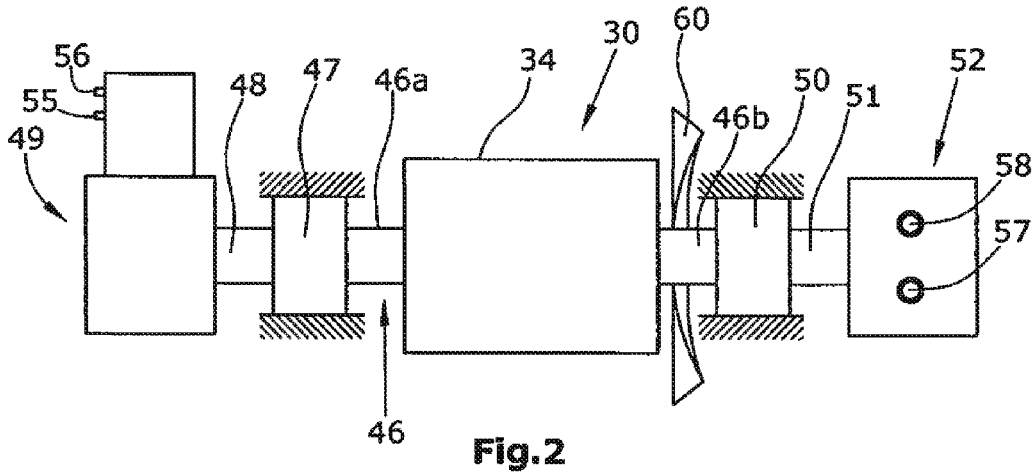
FIG. 2 is a schematic illustration of the structure of the maintenance machine.

FIG. 2 illustrates the internal structure of the maintenance machine 30. The maintenance machine includes a motor 34, whose motor shaft protrudes from the motor housing at opposite ends thereof. The shaft end 46*a* is connected to the input shaft 48 of a compressor 49 via a first freewheel 47. The shaft end 46*b* is connected to the input shaft 51 of a vacuum pump 52 via a second freewheel 50. The freewheels 47 and 50 couple the two adjacent shafts only in one rotational direction, the direction of entrainment, whereas the shafts are decoupled in the opposite direction, the freewheeling direction. The directions of entrainment of the two freewheels 47 and 50 are opposite to each other with respect to the motor shaft. This means that, for example, upon a clockwise rotation of the motor shaft, the freewheel 47 is driven in the direction of entrainment, with the shaft end 46*a* being coupled to the input shaft 48 of the compressor 49 and entraining the same. In contrast, the input shaft 51 of the vacuum pump 52 is decoupled from the shaft end 46*b*. Upon a counterclockwise rotation, the input shaft 48 of the compressor 49 is decoupled from the shaft end 46*a*, while the input shaft 51 of the vacuum pump 52 is entrained by the shaft end 46*b*. The freewheels 47 and 50 additionally function as ball bearings. Their design is similar to that of ball bearings and they have a outer ring connected to the one shaft and an inner ring connected to the other shaft. The freewheels could also be referred to as a one-way clutch.

The motor 34 is reversible so that it can be switched between clockwise and counterclockwise operation. In the one direction of rotation, only the compressor 49 is driven and in the other direction of rotation, only the vacuum pump 52 is driven.

The compressor 49 has an inlet 55 and an outlet 56 to which respective houses can be connected. The vacuum pump 52 also has an inlet 57 and an outlet 58. The line 39 (FIG. 1) is adapted for connection to any of the inlets 55 and 57 of the compressor and the vacuum pump.

A blower 60 in the form of an impeller sits on the motor shaft 46, the blower axially drawing outside air and accelerating the same in the radial direction.

Figure 3:
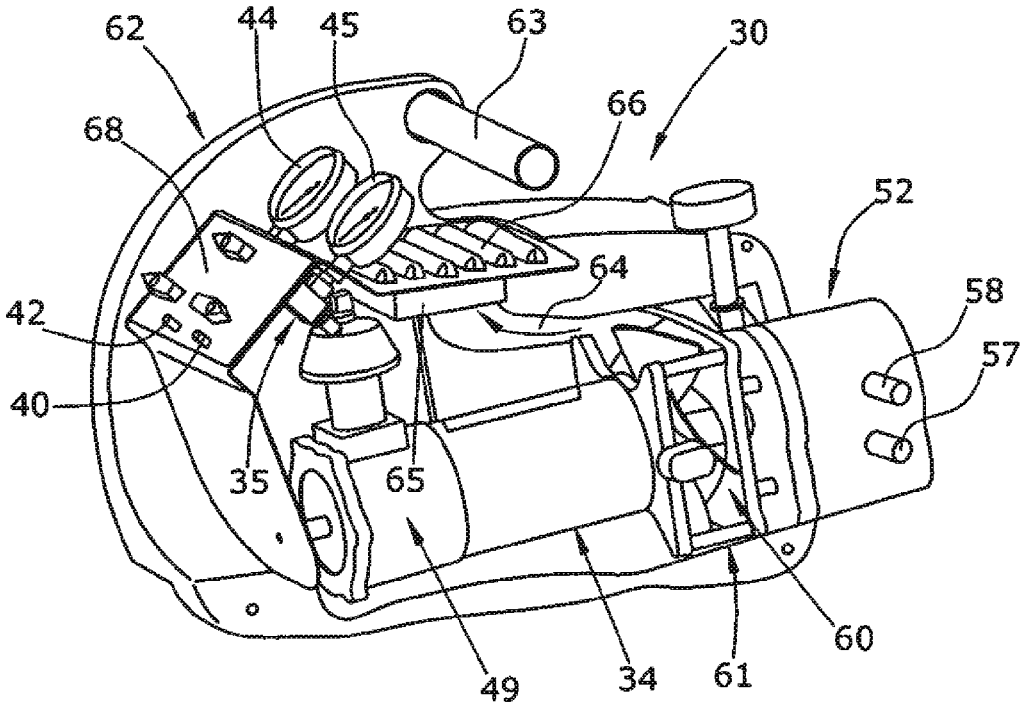
FIG. 3 is a perspective view of the maintenance machine with the housing opened.

FIG. 3 illustrates a preferred embodiment of the structure of the maintenance machine as a portable device. The maintenance machine 30 comprises a housing 62 that can be set on the ground and contains all components including the valve device 35. The housing 62 is provided with a handle 63 allowing the machine to be carried. The housing accommodates the motor 34 that is connected at one end to the compressor 49 and at the other end to the vacuum pump 52. The motor, the compressor and the vacuum pump are arranged along a common axis and are connected through the respective freewheels not visible in FIG. 3. A distance frame 61 in which the blower 60 is arranged is provided between the motor housing and the vacuum pump 52. The blower 60 conveys drawn air radially outward into a ventilation channel 64 that leads to a cooler 65. The cooler 65 is connected to the outlet of the compressor 49 and cools the gas heated by compression. Downstream of the cooler 65, seen in the flow direction, a discharge grating 66 is arranged through which the cooling air leaves the housing 62.

The housing comprises a control and connection panel 68 accessible from outside, the panel being provided with a switch for setting the direction of rotation of the motor 34. Further switches serve to actuate the valve device 35. Further, the connection panel 68 is provided with connectors 40 and 42 of the valve device.

The maintenance machine is used such that the connector 40 of the maintenance machine is connected to the access port 22 of the refrigeration unit 10 through a hose 41 (FIG. 1). The connector 42 is connected to the access port 23 through a hose 43. By switching the motor 34 on to rotate in the one direction of rotation, the compressor 49 is started. The same compresses the refrigerant flowing from the refrigeration unit 10 and conveys the same into a tank 32 in a compressed state (FIG. 1). When the refrigeration unit 10 is emptied, the refrigeration unit is repaired, sealing leaks therein. Thereafter, the vacuum pump 52 is refrigeration unit is connected. By rotating the motor 34, the vacuum pump 52 is started. In this manner, humidity is pumped from the pipe system so that the same is completely emptied and dried. Finally, the refrigeration unit is again filled with refrigerant.

The maintenance machine of the present invention makes it easier for a maintenance technician to empty a refrigeration unit and makes the transport of separate machines with different functions obsolete.

The invention claimed is:

1. A maintenance machine for refrigeration units comprising:

a compressor driven by a motor, said motor being selectively connected to the compressor or to a vacuum pump to drive either the compressor or the vacuum pump;

a first freewheel provided between the motor and the compressor;

a second freewheel provided between the motor and the vacuum pump, wherein the rotational direction of the motor is reversible, and the direction of entrainment of the first and the second freewheel are opposite to each other so that the motor drives the compressor in one direction of rotation and drives the vacuum pump in an opposite direction of rotation; and a valve device provided with a first port, said first port being adapted for fluid connection to the inlets of the compressor and the vacuum pump, the valve device having two further external ports adapted to be separately connected to refrigerant lines of a refrigeration unit, said valve device, in a first state thereof, fluidically connecting the first port solely to one of the further ports and, in a second state, fluidically connecting the first port solely to the other of the further ports.

2. The maintenance machine of claim 1, wherein said motor includes a shaft that drives a blower that, as the compressor is driven, ventilates a cooler connected to the compressor.

3. The maintenance machine of claim 1, wherein the vacuum pump is one of a rotary vane pump or a screw-type compressor.

* * * * *